US006293263B1

(12) United States Patent
Middlebrook

(10) Patent No.: US 6,293,263 B1
(45) Date of Patent: Sep. 25, 2001

(54) COMPACT SUPERCHARGER WITH IMPROVED LUBRICATION

(75) Inventor: James K. Middlebrook, Moorpark, CA (US)

(73) Assignee: Vortech Engineering, Inc., Channel Islands, CA (US)

( * ) Notice: Subject to any disclaimer, the term of this patent is extended or adjusted under 35 U.S.C. 154(b) by 0 days.

(21) Appl. No.: 09/430,912

(22) Filed: Nov. 1, 1999

Related U.S. Application Data

(63) Continuation-in-part of application No. 09/183,066, filed on Oct. 30, 1998.

(51) Int. Cl.[7] ..... F02B 33/00

(52) U.S. Cl. ..... 123/559.1; 123/196 R; 184/6.26

(58) Field of Search ..... 123/559.1, 559.3, 123/196 R; 184/6.12, 6.26

(56) References Cited

U.S. PATENT DOCUMENTS

| | | | | |
|---|---|---|---|---|
| 3,625,310 | | 12/1971 | Herrick | 184/6.12 |
| 3,650,353 | | 3/1972 | Abbott | 184/6.12 |
| 3,885,842 | * | 5/1975 | Furutsu | 308/187 |
| 4,171,137 | | 10/1979 | Aizu et al. | 277/429 |
| 4,423,710 | | 1/1984 | Williams | 123/228 |
| 4,460,284 | * | 7/1984 | Lauterbach et al. | 384/126 |
| 4,630,711 | | 12/1986 | Levrai et al. | 184/6.12 |
| 4,637,493 | | 1/1987 | Ehlert | 184/55.1 |
| 4,752,193 | | 6/1988 | Hörler | 417/407 |
| 4,879,921 | | 11/1989 | Asada et al. | 74/467 |
| 4,944,279 | | 7/1990 | Woodard | 123/559.1 |
| 4,958,601 | | 9/1990 | Lyons | 123/47 R |
| 5,103,777 | | 4/1992 | Daikoku | 123/73 AD |
| 5,205,265 | | 4/1993 | Kashiyama et al. | 123/572 |
| 5,224,459 | | 7/1993 | Middlebrook | 123/559.1 |
| 5,241,932 | | 9/1993 | Everts | 123/195 R |
| 5,281,116 | | 1/1994 | Gwin | 418/94 |
| 5,347,967 | | 9/1994 | Todero et al. | 123/317 |
| 5,375,573 | | 12/1994 | Bowman | 123/196 R |
| 5,467,667 | | 11/1995 | Zaiser et al. | 74/606 |
| 5,513,608 | | 5/1996 | Takashima et al. | 123/196 W |
| 5,537,959 | | 7/1996 | Ito | 123/73 AD |
| 5,579,735 | | 12/1996 | Todero et al. | 123/317 |
| 5,638,796 | | 6/1997 | Adams, III et al. | 123/565 |
| 5,709,186 | | 1/1998 | Taue | 123/196 W |
| 5,715,912 | * | 2/1998 | Maxwell et al. | 184/6.26 |

FOREIGN PATENT DOCUMENTS

| | | |
|---|---|---|
| 0530133 | 3/1993 | (EP) . |
| 2147064 | 5/1985 | (GB) . |
| WO 8902536 | 3/1989 | (WO) . |

* cited by examiner

*Primary Examiner*—Noah P. Kamen
(74) *Attorney, Agent, or Firm*—Kelly Bauersfeld Lowry & Kelley, LLP

(57) ABSTRACT

A compact supercharger having a drive portion, and an atomizer for providing a lubricating oil/air mist to the supercharger. The drive portion has a drive gear with teeth and an outer circumference and a driven gear with teeth and an outer circumference, drive gear bearing races and driven gear bearing races, and a gear case with an inner chamber with a back wall, a front wall, perimeter walls having a swale formed thereon. The drive gear is larger than the driven gear and is position below the driven gear. Drive gear bearing mounting recesses receive the drive gear bearing races, and driven gear bearing mounting recesses receive the driven gear bearing races. An oil/air mist inlet is formed in the gear case, and oil/air mist channels are in communication with the oil/air mist inlet and the driven gear bearing races. A splitter with passageways is located near a bottom of the gear case in the vicinity of an oil outlet. The outer circumference of the drive gear is in close proximity to the perimeter walls of the inner chamber and an upper face of the separator portion. During rotation of the drive gear, oil/air mist will be expelled against the perimeter wall portion to aid in separating the air from the oil, the oil will travel down the swale, through the passageways of the splitter, and exit through the oil outlet, thereby preventing windage of the oil in the gear case and assisting in power draining of oil from the gear case.

42 Claims, 10 Drawing Sheets

2
5
4
68a
42
26
74a
72
90
70
52
92
108
68b
110
76
60a
34
102
74b
62
60b
58b
58a
88
24
44
84
86
56a
64
56b
104
54b
28
54a
96
22
50
32
46
26
90
52
80
78
16
20
12
10
18
14

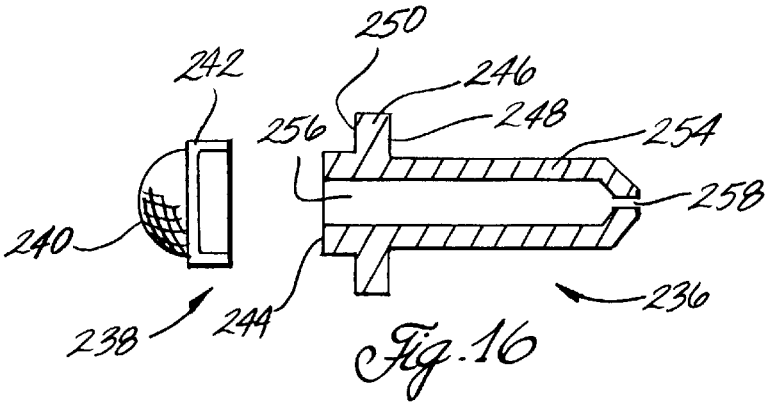
Fig. 16
Fig. 15
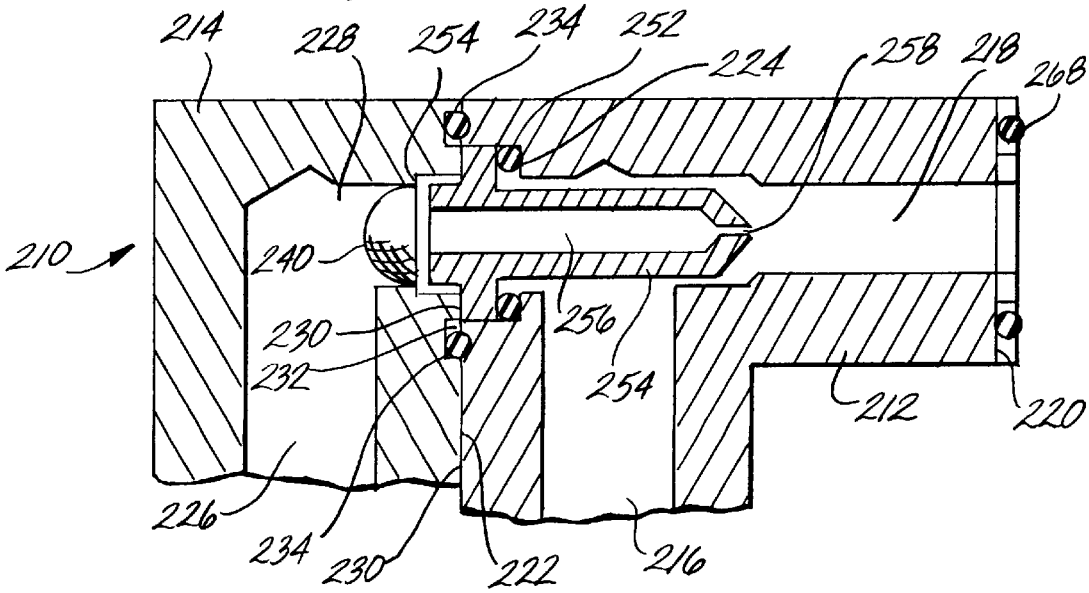

COMPACT SUPERCHARGER WITH IMPROVED LUBRICATION

CROSS-REFERENCE TO RELATED APPLICATION

This is a continuation-in-part of inventor's co-pending application Ser. No. 09/183,066, entitled "Compact Supercharger" filed Oct. 30, 1998, which is still pending.

FIELD OF THE INVENTION

Supercharger for internal combustion engines and other applications, and more particularly a low profile supercharger having an oil misting lubrication system and a power drain system for expelling oil out of the case after oil has lubricated the supercharger.

BACKGROUND OF THE INVENTION

Supercharging of internal combustion engines is a well established method of obtaining greater power output from engines of a given size. Due to the extremely high rotational speeds of the compressor, gears, bearing races, and other moving parts of superchargers, it is imperative to maintain adequate lubrication in superchargers. In addition to preventing excessive wear of parts, lubrication aids in cooling of the parts.

In present superchargers, lubrication slingers are commonly used to provide lubrication to the moving part. See for example U.S. Pat. No. 5,638,796 to Adams, III et al., which discloses an electric supercharger with a lubrication slinger, and U.S. Pat. No. 4,171,137 to Aizu et al., which discloses a slinger arrangement for use with the bearing of superchargers. Others indicate, in a general manner, that some oil will be kicked up by the slinging and create an oil mist that will tend to provide some lubrication. See for example U.S. Pat. No. 5,281,116 to Gwin, U.S. Pat. No. 5,241,932 to Everts, U.S. Pat. No. 4,423,710 to Williams, and U.S. Pat. No. 5,579,735 to Todero et al. U.S. Pat. No. 4,752,193 to Horler discloses using the venturi effect created by a turbocharger to aid in evacuating oil that collects at the bottom of the supercharger's gear case.

U.S. Pat. No. 5,375,573 to Bowman disclosing a two-stroke internal combustion engine having a pressurized air rail. The pressurized air rail is for producing an atomized fuel spray for injection into the individual combustion chambers, in which oil for lubrication is atomized by metering it into a stream of compressed air taken from the rail or a reservoir connected thereto and the resulting oil/air mist is injected into the crankcase and/or the lower part of the cylinder selectively and directly onto points requiring lubrication. Bowman discloses that to reduce the load on the air compressor feeding the pressurizing rail, the compressed air supply for the oil atomization may be supplemented by an engine supercharger, if one is utilized. Bowman further states that each cylinder of the engine is provided with a plurality of lubricating jets or nozzles to generally direct atomized oil locally to easily accessible parts and components in a two stroke engine such as the small-end bearings, big-end bearings, the piston skirt and piston ring areas. Bowman does not disclose use of a misting oil/air system for lubricating supercharger bearings, or using a misting oil/air system for lubricating less accessible components such as bearing races press fitted into bearing race cavities in superchargers.

Superchargers are frequently belt driven and have gears in a gear case to substantially gear up the rotational speed so that the compressor of the supercharger will generate sufficient boost. In presently available superchargers, the space inside the gear case is purposely made relatively large, with much space between the gears and the walls of the gear case so that oil can be flung onto the various gears and bearings. However, one side effect of large cases is that oil that accumulates in the bottom of the case to be drained is sometimes whipped up by the gears and become foamy. This foamed oil hinders drainage, and as a result the oil will increase in temperature, and lower the performance of the supercharger.

Although there has been a substantial amount of development work on more efficient designs for superchargers, there remains a need for improved superchargers that are more compact in design, are better lubricated, and that are more durable, more efficient, and readily installable onto different engines.

SUMMARY OF THE INVENTION

The inventor has developed a supercharger that includes certain features that significantly improve the lubrication of its gears and which provides a low profile supercharger. The supercharger unit itself takes filtered air, preferably from a cool location, in-from the center of the compressor wheel which has radial vanes and which accelerate the air. The air, leaving the impeller, is diffused and slowed, thus compressing it before discharging the air essentially tangentially with respect to the vanes. The compressor wheel is located in a shallow bore which is of a depth to receive the base or vane supporting part of the compressor wheel such that the air from the compressor wheel flows smoothly into the volute with no abrupt discontinuity or drop off to create turbulence or eddies.

The supercharger includes a drive shaft that carries an external pulley driven by the associated motor. The drive shaft extends into a drive portion of the supercharger. The drive portion has a gear case containing a larger drive gear that meshes with and drives a smaller driven gear. The gear case has an inner chamber with a back wall, a front wall, and perimeter walls having a swale formed thereon. Drive gear bearing mounting recesses receive drive gear bearing races (or other rolling elements), and driven gear bearing mounting recesses receive driven gear bearing races (or other rolling elements). The driven gear is connected to the compressor through a driven shaft. Both the drive and the driven gears can be standard with the gears representing about a 3.45:1 ratio for increased rotational speed of the compressor wheel, relative to engine speed, and both the drive and driven shafts are carried by bearing races. Of course, other gear ratios can be used. Also, while the supercharger finds a major use in motor vehicles, the supercharger can be used in industrial applications, such as to provide a high volume of high speed air.

To provide for better performance and reliability over wide temperature ranges, the supercharger can also preferably include bearing holding inserts made of metal having similar expansion characteristics to that of the bearings and moving parts so that differential expansion and contraction of the gears, shafts, and bearings, typically made of ferrous materials, and the gear case, typically made of aluminum alloy are compensated, to thereby avoid problematic tolerance changes between the ferrous material parts and the aluminum alloy parts.

The compact supercharger preferably also includes an atomizer for providing a lubricating oil/air mist to the supercharger. One advantage of using an oil/air mist for lubricating the driven gear bearing assemblies is that the oil can be readily sprayed into the bearings, thereby achieving quick and excellent penetration. Further, the pressurized air atomizes the oil and improves distribution and will also assist in driving the oil out of the gear case after it is used, thereby shorting the cycle time of the oil in the gear case, and providing improved lubrication and cooling of the gear case. An oil/air mist inlet is formed in the gear case, and oil/air mist channels are in communication between the oil/air mist inlet and the driven gear bearing races. A splitter with passageways is located near a bottom of the gear case in the vicinity of an oil outlet. The outer circumference of the drive gear is in close proximity to the perimeter walls of the inner chamber and an upper face of the splitter. During rotation of the drive gear, oil/air mist will be expelled against the perimeter wall portion to aid in separating the air from the oil, the oil will travel down the swale and groove, through the passageways of the splitter, and exit through the oil outlet, thereby preventing windage of the oil in the gear case and assisting in power draining of oil from the gear case. Alternately, the supercharger can be used simply with pressurized oil rather than an oil/air mist, in which case oil alone will travel through the channels and be dispelled onto the bearing races.

As noted above, the supercharger of the invention has predominant applications in the area of internal combustion engines to increase the power and efficiency for a motor of a given displacement. In addition, the compact supercharger of the invention has other notably uses, including use in industrial applications for producing large volumes of high speed air. In addition, the compact supercharger can be used as a blower for aircraft deicing equipment which relies on high speed air rather than chemicals to melt ice that has accumulated on aircraft wings. Other applications include industrial blowers. In these other applications, the drive shaft can preferably be rotated by electric, pneumatic or hydraulic motors in addition to internal combustion engines.

BRIEF DESCRIPTION OF THE DRAWINGS

This invention may be more clearly understood from the following detailed description and by reference to the drawings in which:

FIG. 15 is a detail view showing the atomizer of FIG. 14.

FIG. 16 is an exploded view showing the jet and the filter cap of the atomizer.

DETAILED DESCRIPTION OF THE INVENTION

Figures 1, 3, 6:
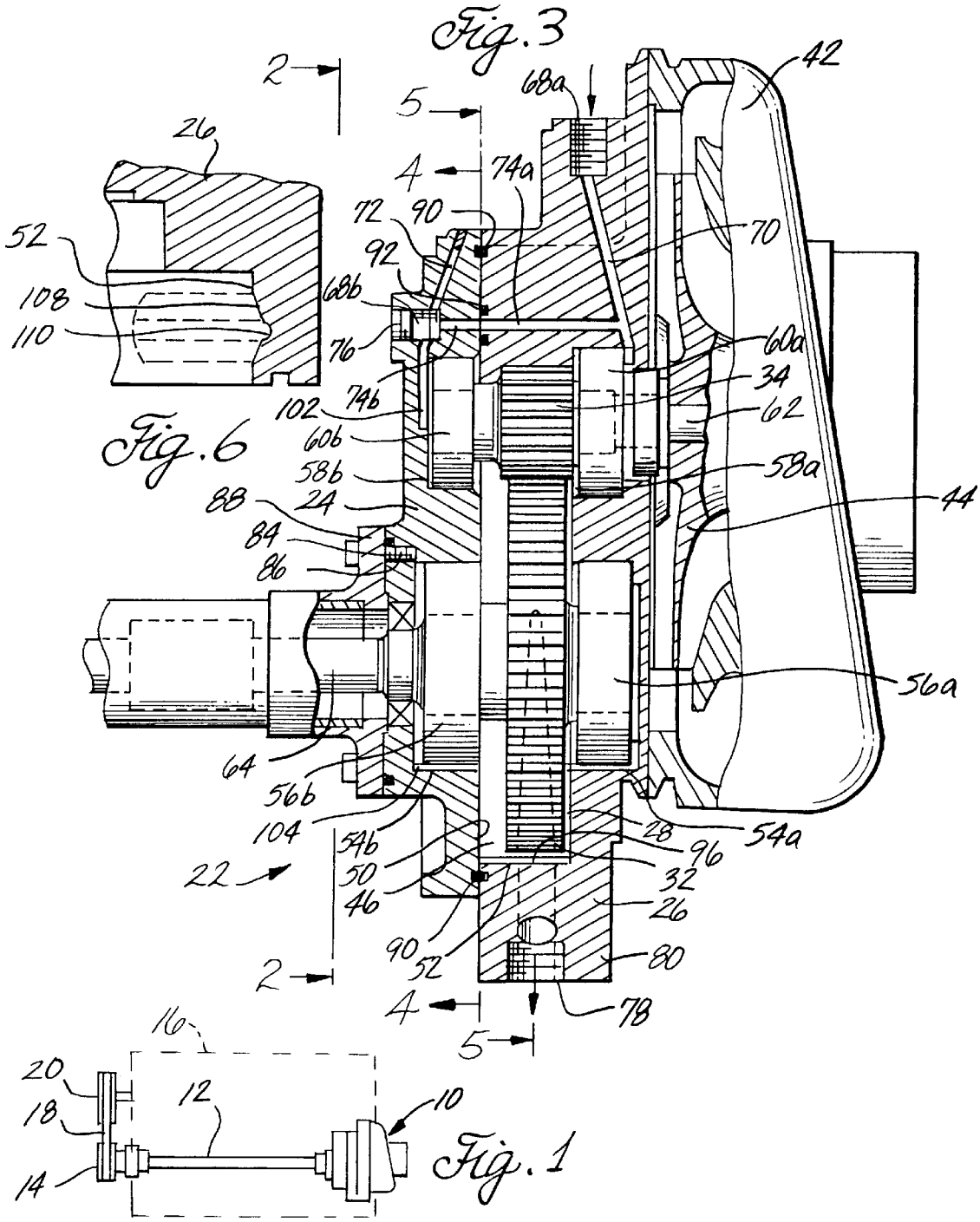
FIG. 1 is a side view showing a supercharger, its drive shaft, and pulley arrangement attached to an engine.
FIG. 3 is a partial cross-sectional view along lines 3—3 of FIG. 2 showing details of supercharger.
FIG. 6 is a cross-section view through view lines 6—6 of FIG. 5 showing the swale and groove on the perimeter walls of the back portion of case.

Referring to FIG. 1, a side view of the supercharger 10 of the invention and its drive input 12 with its attached pulley 14 are shown attached to a part of the engine 16 and driven by a belt 18 connected to an engine pulley 20. While the drive input 12 is shown as relatively long, it can be relatively short so that the supercharger 10 will be placed in close proximity to the engine pulley 18, or can be used without an extended drive and the pulley can be placed directly on the supercharger. The inventor's co-pending patent application "Drive Extender for Supercharger", filed Oct. 30, 1998 as application Ser. No. 09/183,784, further discusses an elongate drive input that permits superchargers to be displaced a substantial distance away from the engine's belts and pulleys.

Figure 2:
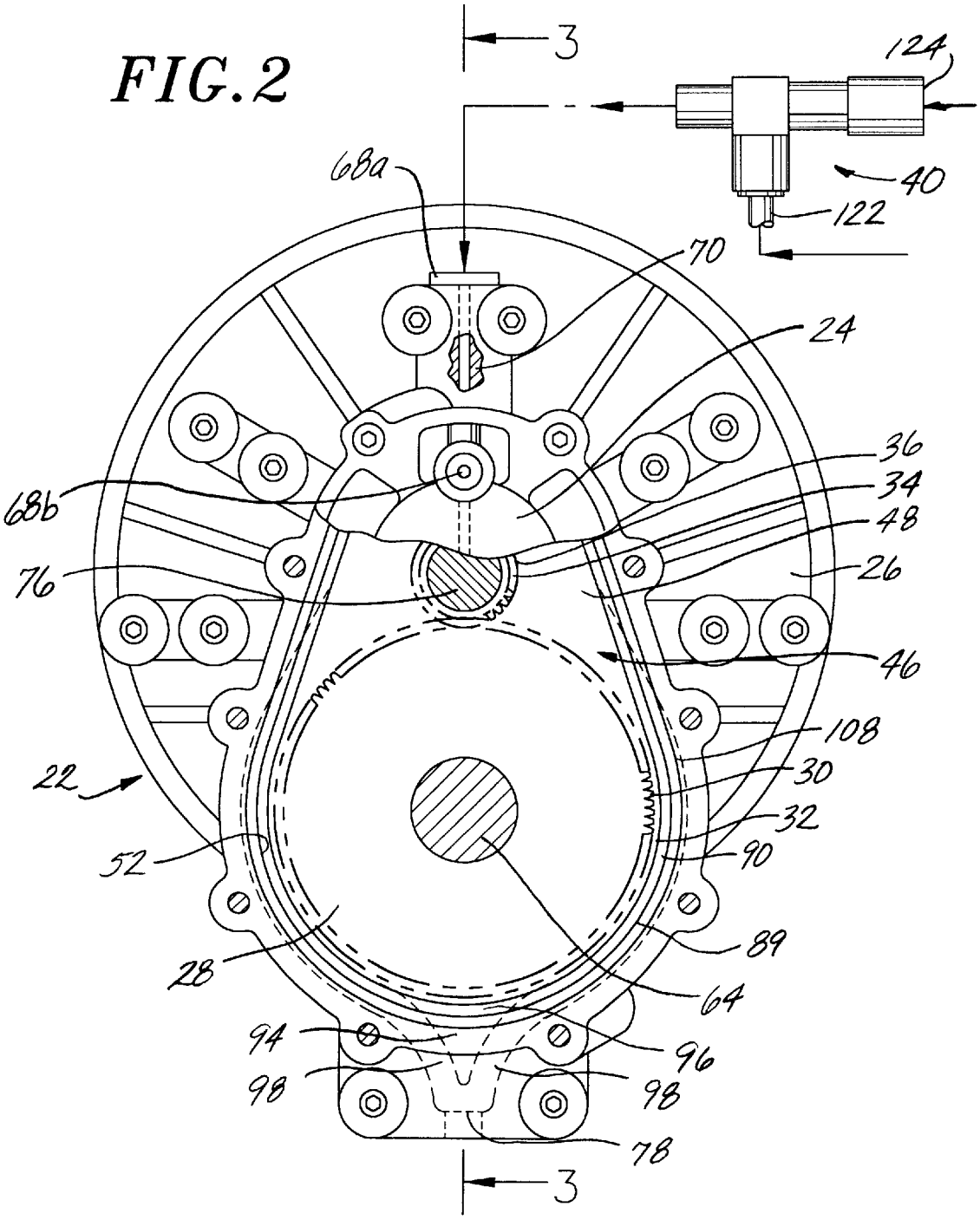
FIG. 2 is a front partially cut-away view of a gear case of the supercharger showing the gears and internal structure.

FIG. 2 is a front partially cut-away view of a gear case 22 of the supercharger 10 showing gears and its internal structure. Cover 24 of gear case 22 is partially broken away from the back portion 26 of gear case 22 to show drive gear 28 with its teeth 30 and outer circumference 32 and driven gear 34 with its teeth 36 and outer circumference 38. Circumference 32 of drive gear 28 is larger than the circumference 38 of driven gear 34 and drive gear 28 is positioned below driven gear 34 in gear case 22. An atomizer 40 is attached to gear case 22. Cover 24 and back portion 26 define gear case 22 having an inner chamber with a back wall and perimeter walls (the back portion 26) and a front wall (the cover 24).

FIG. 3 is a partial cross-sectional view of supercharger 10 along lines 3—3 of FIG. 2 showing additional details. Supercharger 10 has a volute 42 and a compressor wheel (or impeller) 44 positioned in the volute 42. When placed together, back portion 26 of gear case and cover 24 of gear case define an inner chamber 46 with a back wall 48, a front wall 50, perimeter walls 52, drive gear bearing mounting recesses 54*a* and 54*b* to receive drive gear bearing races 56*a* and 56*b* (or other known bearing means), and driven gear bearing mounting recesses 58*a* and 58*b* to receive driven gear bearing races 60*a* and 60*b* (or other known bearing means). Driven gear 34 is connected to an impeller-carrying shaft 62 to which impeller 44 is attached. Power to drive the supercharger 10 is supplied by a drive gear shaft 64 connected to drive gear 28. For purposes of reference, gear case 22 and its associated gears 28 and 34, bearing races 56*a* and 56*b* and 60*a* and 60*b*, and shafts 62 and 64 are referred to as the "drive portion" 66 of the supercharger. At least one oil inlet 68*a* and/or 68*b* is formed in gear case 22 to receive engine oil (either in an oil/air mist supplied by atomizer 40, or simply oil if no atomizer is used.) For greater versatility, oil inlets 68*a* and 68*b* can be formed in back portion 26 and cover 24 of case 22, respectively. A channel 70 is formed in back portion 26 of case in communication between oil inlet 68*a* and the driven gear bearing mounting recess 58*a*, and a channel 72 is formed in cover 24 of case 22 in communication between oil inlet 68*b* and the driven gear bearing mounting recess 58*b*. Channels 70 and 72 preferably communicate with each other via aligned channel sections 74*a* and 74*b* joining the two so that no matter which inlet 68*a* or 68*b* oil/air mist via atomizer 40 (or simply pressurized oil if no atomizer is used) is connected to, both sets of bearing races 60*a* and 60*b* in recesses 58*a* and 58*b* will be adequately lubricated. The inlet 68*a* or 68*b* not used will be plugged, such as with a bolt 76 or other means. An oil outlet 78 is formed at the bottom 80 of the gear case 22. An oil drain hose (not shown) connects to oil outlet 78 and connects to the oil pan of the vehicle (not shown). Cover 24 of case 22 has a flat face 84, which is perpendicular to the axis of drive gear shaft 64. Bolt holes 86 are formed on face. A flange 88 also with a flat face ensures accurate alignment of drive gear shaft 64 when bolted to flat face 84 of cover 24 of case 22. As shown, drive gear 28 has a larger circumference than driven gear 34 and drive gear 28 is positioned in gear case 22 below driven gear 34. The teeth of drive gear 28 and driven gear 34 mesh together.

Turning again to FIG. 2, a groove 89 is formed in back portion 26 of case 22 into which an O-ring 90 fits to provide a tight seal between front cover 24 of case 22 and back portion 26 of case.

Turning again to FIG. 3, a small O-ring 92 provides sealing between channel sections 74*a* and 74*b*.

Figure 4:
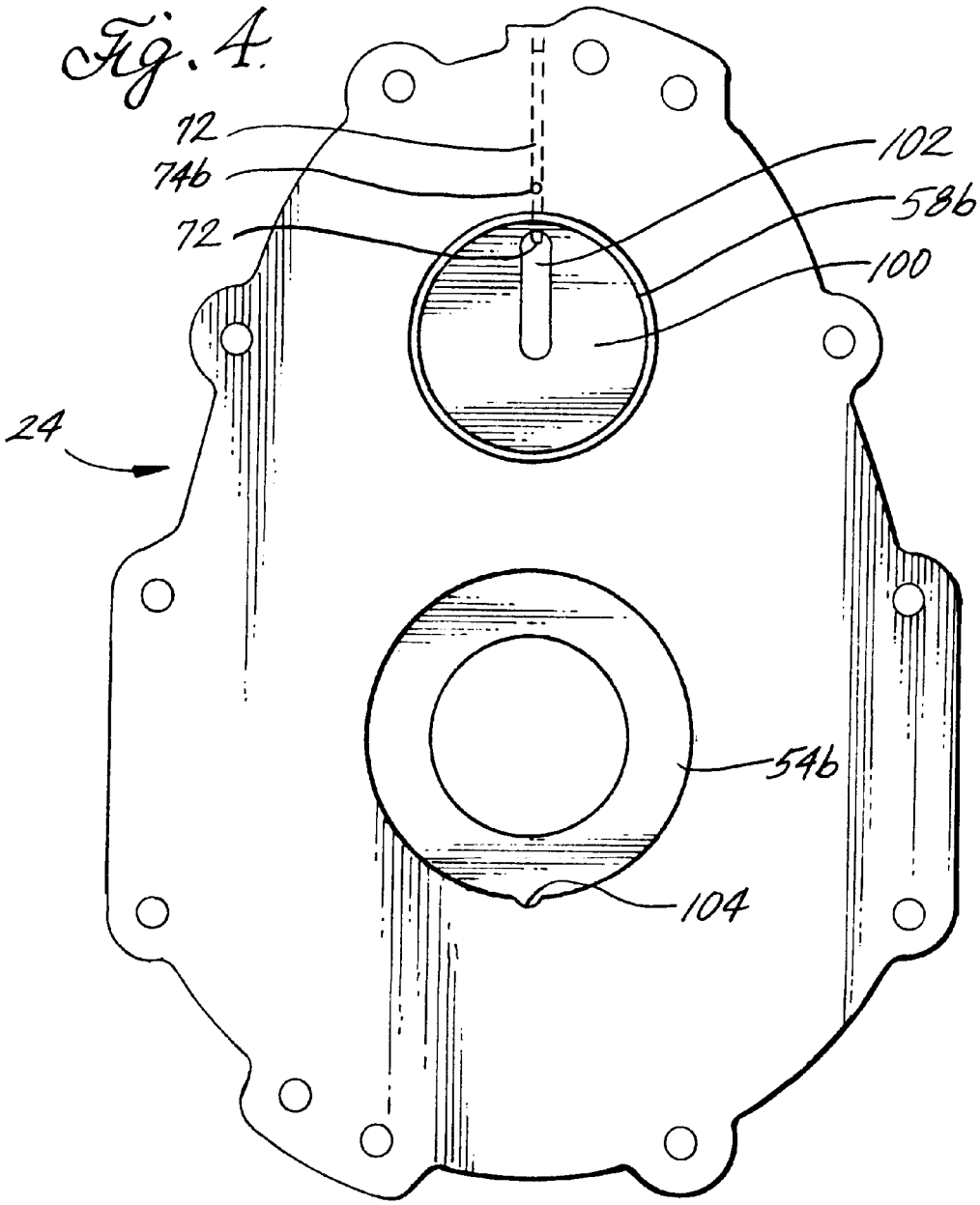
FIG. 4 is a rear perspective view of the inside of the cover of the gear case.

Referring now to FIG. 4, a rear view of front cover 24 of the gear case 22 is shown. Formed on a back wall 100 of recess 58*b* is a slot 102. Channel 72 communicates with slot 102, and slot 102 helps to distribute the oil or oil/air mist onto bearings (not shown). A groove 104 is formed at the bottom region of recess 54*b*. Groove 104 aids in draining oil from drive bearing (not shown).

Figure 5:
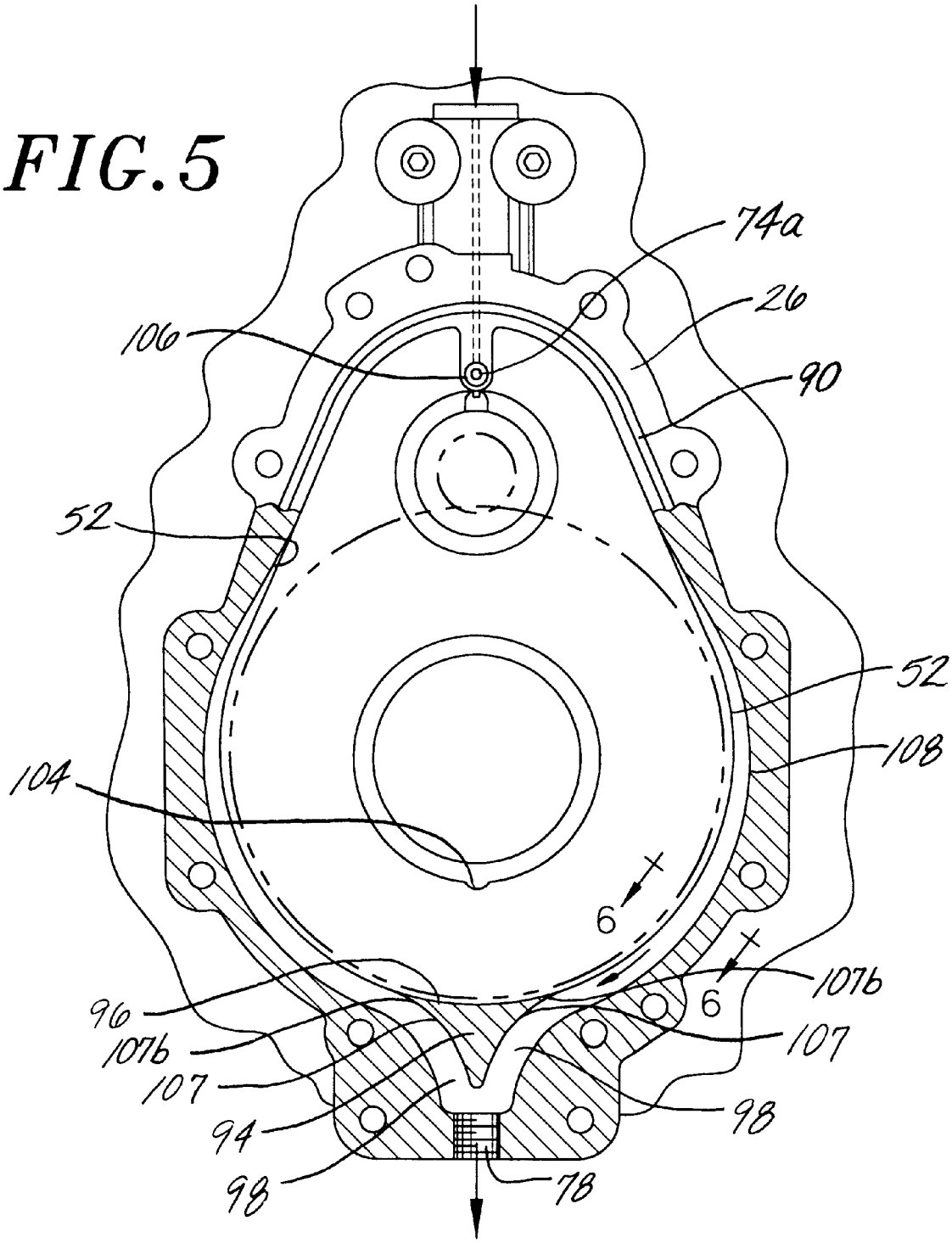
FIG. 5 is a partially cut-away front view of the back portion of the gear case with gears and bearings removed.

FIG. 5 is a partially cut-away view of back portion 26 of gear case 22 with gears and bearings removed to show details and with the lower part of the back portion of gear case 26 cut away. An O-ring receiving groove 106 is formed around channel section 74*a* to receive O-ring 92 to form a liquid tight seal of channel sections 74*a* and 74*b*. A splitter 94 is located near a bottom of the back portion 26 of gear case 22 near the oil outlet 78. Splitter 94 has a curved upper face 96 that is in close proximity to the outer circumference 32 of drive gear 28, and passageway (or channel) 98 communicating with oil outlet 78. Splitter 94 preferably also has concavely curved inner side walls 107, but they could also be straight. Leading edges 107*b* are formed on the face of splitter 94. Perimeter walls 52 have a swale 108 formed along at least a portion of perimeter walls 52 in the vicinity of the portion of the case receiving the drive gear (not shown). Swale 108 can extend into passageways of the splitter. Swale 108 also preferably has groove 110 formed thereon.

FIG. 6 is a cross-section view through view lines 6—6 of FIG. 5 showing swale 108 and groove 110 on the perimeter walls 52 of the back portion 26. Referring again to FIGS. 5 and 6, swale 108 and groove 110 help direct the oil thrown off of drive gear 28 and onto perimeter walls 52 downward. During rotation of drive gear 26, oil or oil/air mist will be expelled against the swale 108 of perimeter wall 52 (and thereby help separate the air from the oil), travel down the swale and groove 110 of perimeter walls 52, and exit through oil outlet 78, thereby preventing windage of the oil in gear case 22. An oil drain hose (not shown) is connected to oil outlet 78 for connection back to the engine's oil supply. The concavely curved inner side walls 106 of splitter 94 (which could also be straight), in combination with the rotation of drive gear 28 helps ensure that oil is propelled downward and outward of oil outlet 78 rather than spinning around the gear case 22. Obviously, drive gear 28 can rotate in a clockwise or counterclockwise direction (since properly configured, either direction can generate boost for the supercharger.) For clockwise rotation of drive gear 28, oil will mostly be propelled down the right side of passageway 98, and for counterclockwise rotation of drive gear 28, oil will mostly be propelled down the left side of passageway 98. Since the rotational speed of the drive gear 28 and its bearing races 56*a* and 56*b* are considerably slower, direct point lubrication as described above with respect to the driven gear bearing races 60*a* and 60*b* and driven gear 34 has not been found to be necessary. The oil being splashed from the driven gear 34 adequately provides lubrication of the drive gear 28 and drive gear bearing races 56*a* and 56*b* and the driven gear 34 and driven gear bearing races 60*a* and 60*b*.

Figure 7:
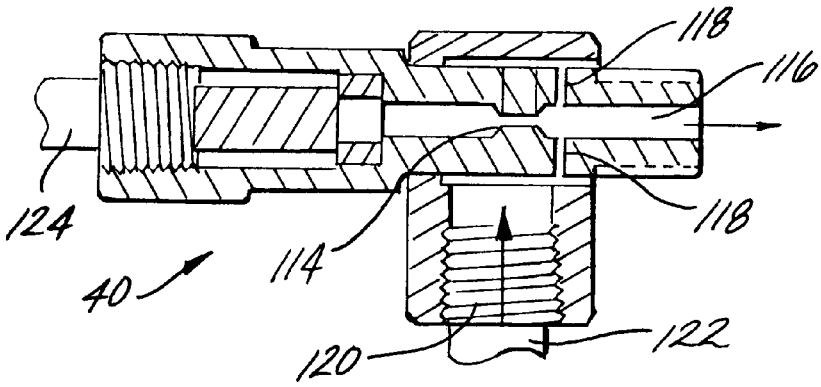
FIG. 7 is a cross-sectional view of the oil/air atomizer.

FIG. 7 is a cross-sectional view of the oil/air atomizer 40. Atomizer has an oil inlet end 124, an oil jet 114, a downstream channel 116, and at least one and preferably two or more pressurized air aperture 118 formed into the downstream channel 116. Pressurized air is supplied to the air apertures 118 via a pressurized air inlet 120. The pressurized air for the atomizer can preferably be supplied from the volute 42 of the supercharger 10 via a hose 122. The oil can be supplied via a hose 124 from the engine. The pressurized air merges with the oil to form an oil/air mist that exits an oil/air mist outlet end. The atomizer 40 can be directly connected to one of the oil/air mist inlets 68*a* or 68*b*, or the outputted oil/air mist can be delivered via a hose (not shown).

For superchargers, blowers and other devices that must operate dependably over a wide range of temperatures, problems sometimes arise with operation of the precision rolling element bearings (called ball or roller bearings) typically used in these devices. In an effort to produce a device that is reasonably lightweight, as noted above, the preferred case or housing material has been aluminum, cast or otherwise. The bearings usually have an outer ring made of steel alloy with a groove or race for the balls to ride in and maintain a precise clearance for the rollers or balls. There is a large differential in thermal expansion between the bearing's outer ring and the bore in the aluminum housing because the aluminum housing expands or shrinks at roughly three times the rate of the steel outer ring. Indeed, in very cold climates, upon start up, the devices can be extremely cold and unexpanded, yet in a short time can heat up and expand considerably. This can cause an improper fit between the various parts that can lead to premature bearing failure and excess wearing of moving parts.

The invention provides a novel solution to this problem, involving the use of cups or sleeves of cast iron, steel, and other ferrous materials, titanium, and other suitable materials. These cups or sleeves will be incorporated into the case and help stabilize the expansion rate relative to the bearings within reasonable limits. These cup or sleeves can preferably be cast into the housing or set in place after the case is machined.

Another related problem is the relative movement between the bearing bores due to the differential in thermal expansion that results in changes of the center to center distance of parallel shafts. This is undesirable for shaft alignment and gear mesh. To offset this problem, the cups or sleeves can be connected together with one or more webs or struts. This arrangement will limit the amount of movement to that of the expansion rate of the cup/sleeve and strut assembly, which will thereby tend to match expansion in the shafts and gears to the distance they are spaced apart.

Having briefly described the problems caused by differential thermal expansion of different parts in a supercharger and blower, a detailed explanation of the solution is set forth in FIGS. 8–13.

Figure 8:
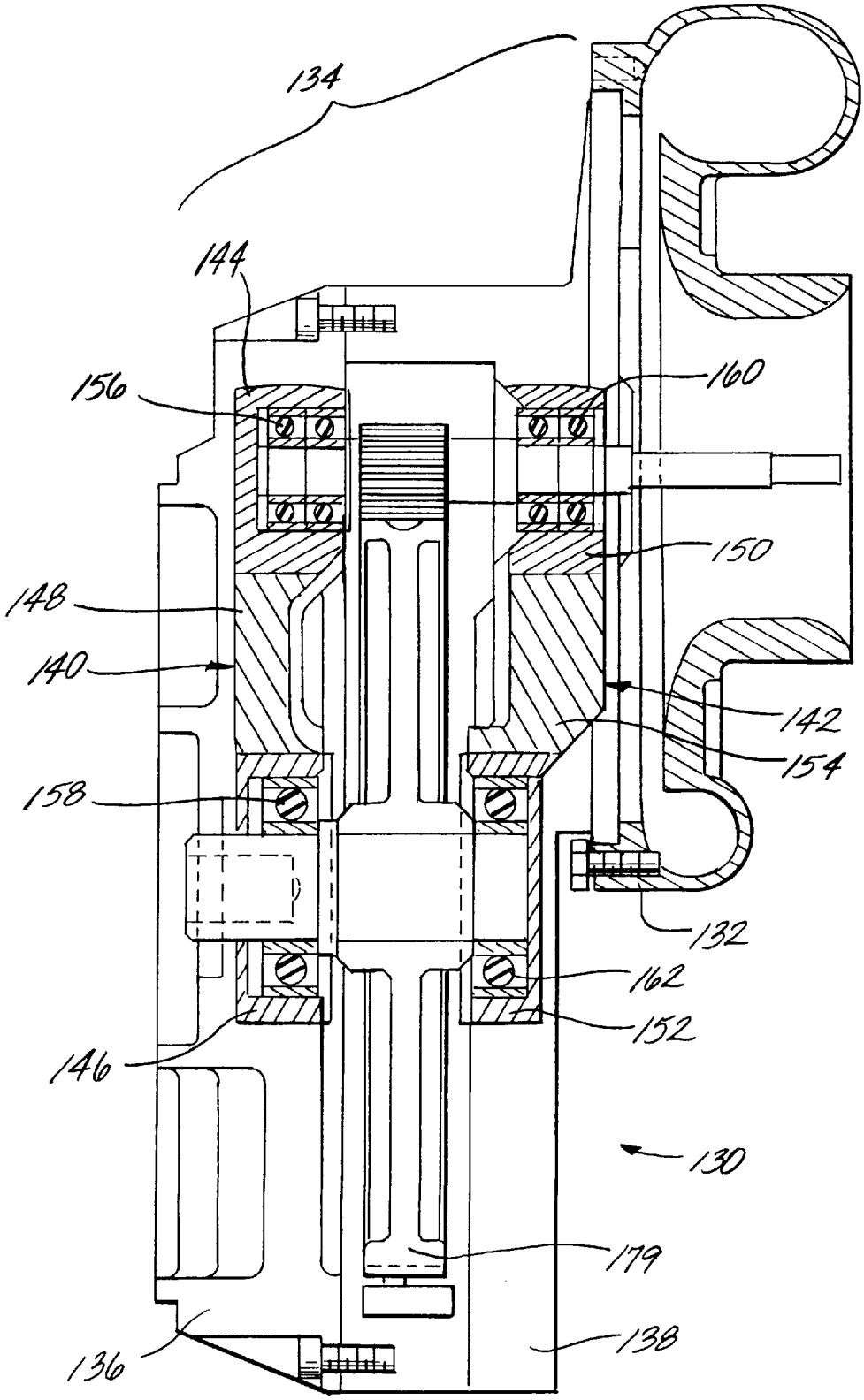
FIG. 8 is a cross-sectional view of a second embodiment of a supercharger of the invention.

FIG. 8 is a sectional view showing an alternate embodiment of a supercharger 130 having a volute 132 and a gear case 134 with a cover 136 and a back portion 138. Back portion 138 engages with volute 132. Cover insert 140 is incorporated with cover 136, which can be accomplished by inserting cover insert 140 (which is preferably formed of a first material, such as cast iron, steel, titanium, or other suitable materials) into cover 136 during a casting process. Back portion insert 142 is incorporated with back portion 138, which similarly can be accomplished by inserting back portion insert 142 into back portion 138 when it is cast. Alternatively, inserts 140 and 142 can be pressed into cover 136 and back portion 138, respectively, or attached in another known manner.

Figure 9:
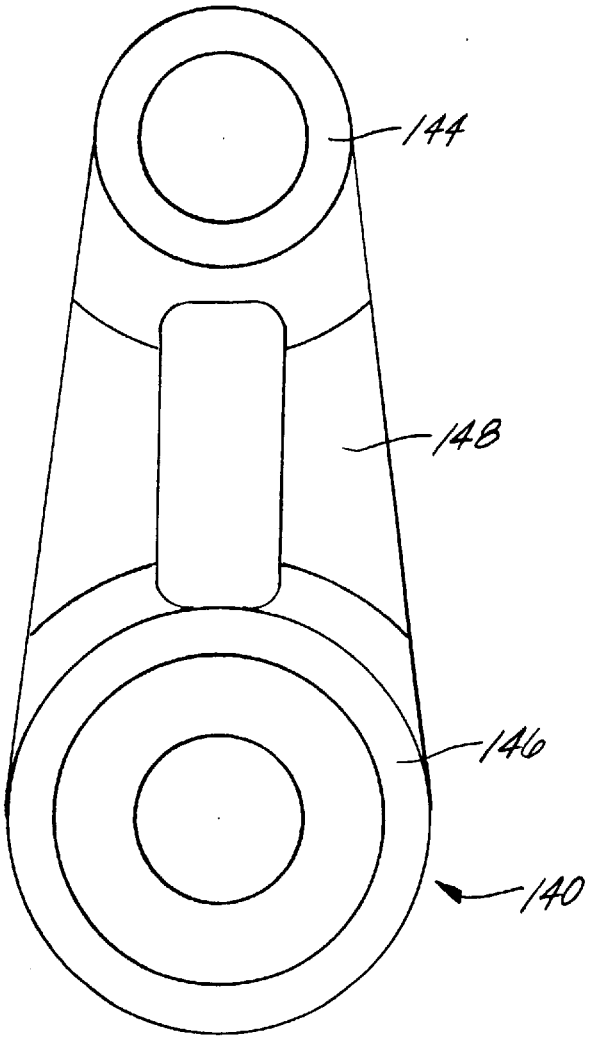
FIG. 9 is a top plan view of a cover insert portion.
Figure 10:
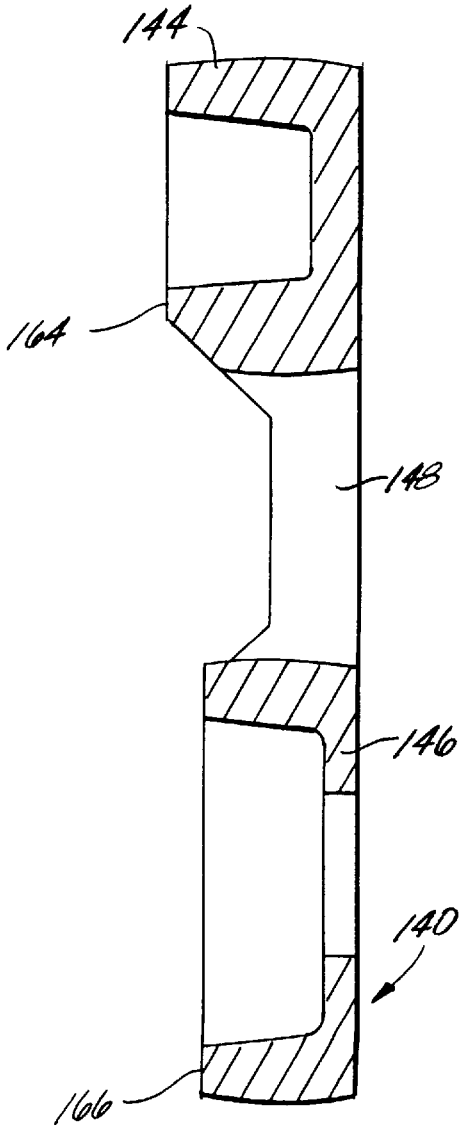
FIG. 10 is a side view of the cover insert of FIG. 9.
Figure 11:
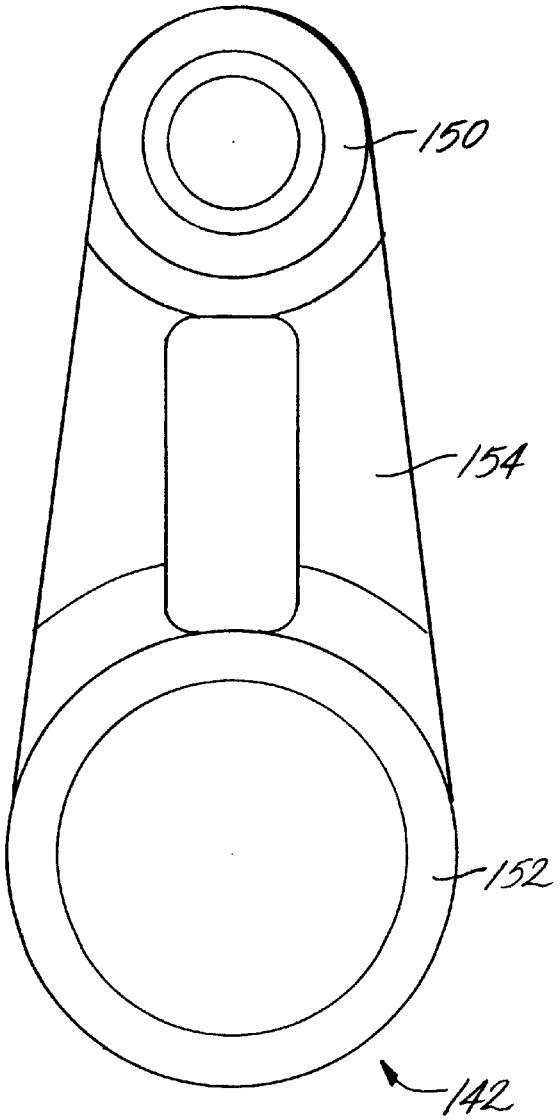
FIG. 11 is a top plan view of a base insert.
Figure 12:
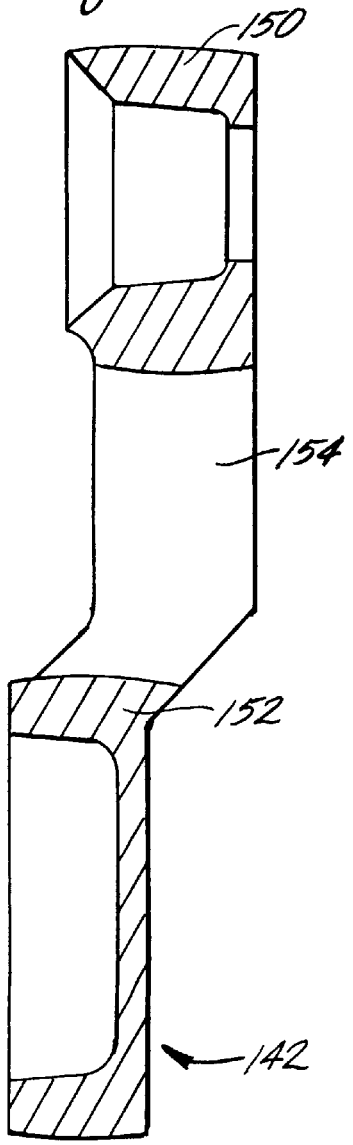
FIG. 12 is a side view of the base insert of FIG. 11.

Turning to FIGS. 9–12, inserts 140 and 142 are shown. Cover insert 140 has bearing cups 144 and 146, joined together by struts 148, as shown in FIGS. 9 and 10, and base portion insert 142 has bearing cups 150 and 152 joined together by struts 154, as shown in FIGS. 11 and 12. Bearing cups 144 and 146 of insert 140 are adapted to receive roller element bearings 156 and 158, respectively, and bearing cups 150 and 152 of base portion insert 142 are adapted to receive roller element bearings 160 and 162, as shown in FIG. 8.

As noted above, inserts 140 and 142 are preferably made of a material having similar thermal expansion qualities to that of the gears, gear shafts and bearing. Cast iron has been found to function well for typical application where the gears, shafts and bearings are formed of ferrous materials. Cast iron inserts 140 and 142 can be cast together with the aluminum cover 136 and base portion 138, respectively, of case 134, and help ensure that thermal expansion of the supercharger 130 through a wide range of temperatures will not have a deterioration affect on fit and interaction of the bearings, gears, and other moving parts.

For purposes of definition, the 12 o'clock position of gear case will refer to the uppermost point of drive gear, and the 6 o'clock position is the lowermost point of drive gear. Bores, channels, and slots are formed in inserts 140 and 142 as required for gear shafts, lubrication channels, drains, etc., just as with the embodiment of supercharger 10 of FIG. 1.

Figure 13:
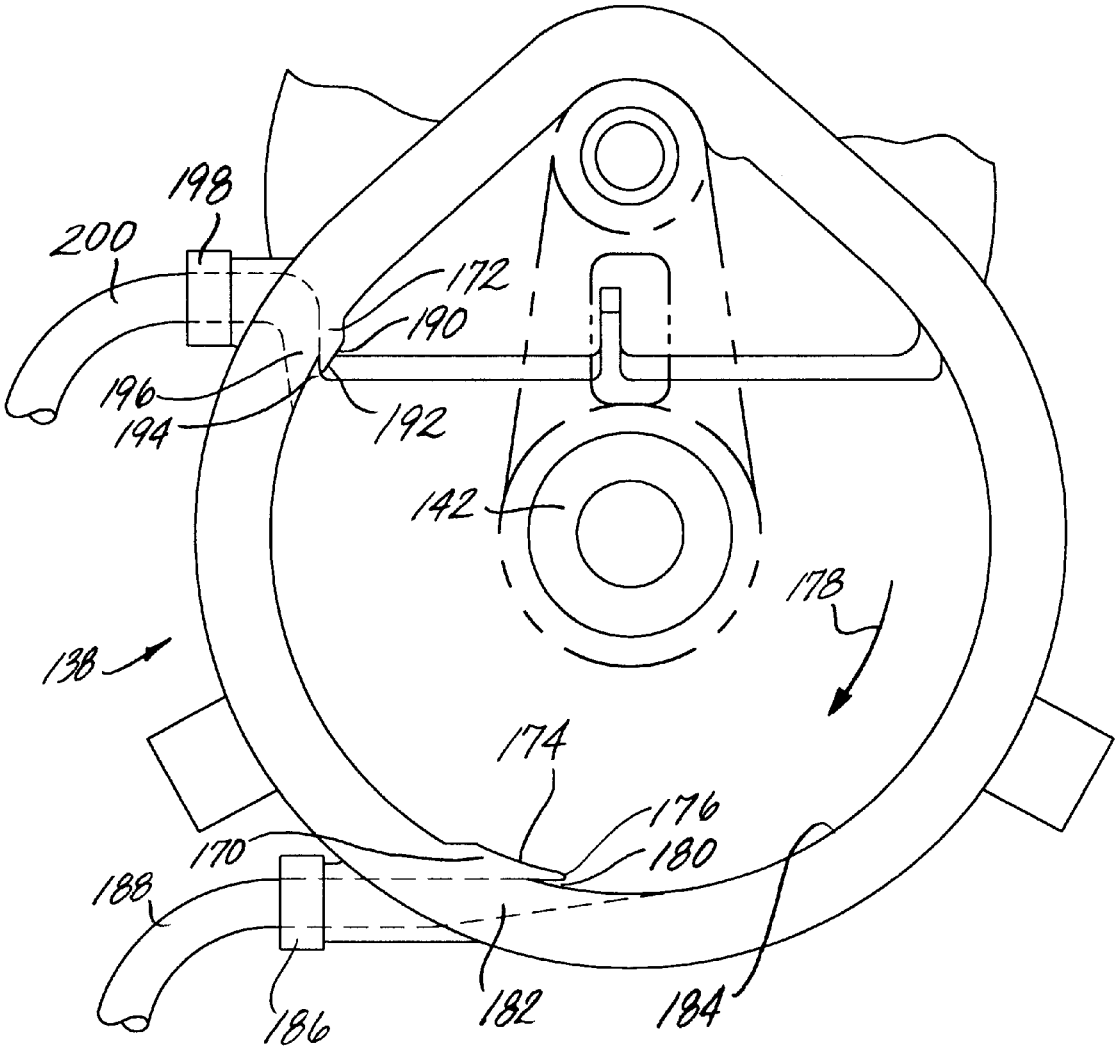
FIG. 13 is a plan view of the base portion of the gear case.

Turning to FIG. 13, a top plan view of base portion 138 of case 134 of supercharger 130 is shown. In addition to including base portion insert 142, supercharger 130 has a first splitter 170 and a second splitter 172. First splitter 170 has a raised face 174 which preferably has a lip 176 which juts forward against a direction of travel 178 of drive gear 179 (as shown in FIG. 8.) Lip 176 forms a recess 180. A first drain channel 182 extends from a portion of a perimeter 184 of back portion 138 (under lip 176) to a first drain exit 186. Teeth of drive gear will pass closely to raised face 174, and as a result, substantially all lubricating oil at the lip will be swept into first drain channel 182 and out of first drain exit 186, where it can travel out through first drain line 188. Second splitter 172 likewise has a raised face 190, a lip 192, a recess 194 under lip 192, and a second drain channel 196 and a second drain exit 198. A second drain hose 200 is connected to second drain exit 198, which drains oil to an oil source. First splitter 170 is located at approximately the 7 o'clock position and second splitter 172 is located at approximately the 10 o'clock position. Splitters 170 and 172 can be located at other positions.

The second embodiment of supercharger 130 is designed for a single direction of rotation of the drive gear 179, and also is adapted so that supercharger 130 can be installed with either its first drain exit 186 or its second drain exit 198 in a lowermost position, or alternatively at some intermediate position there between, to allow for more versatility in the orientation in which supercharger 130 can be mounted. The two splitter design of the second embodiment of supercharger 130 provides for enhanced drainage of oil.

Figure 14:
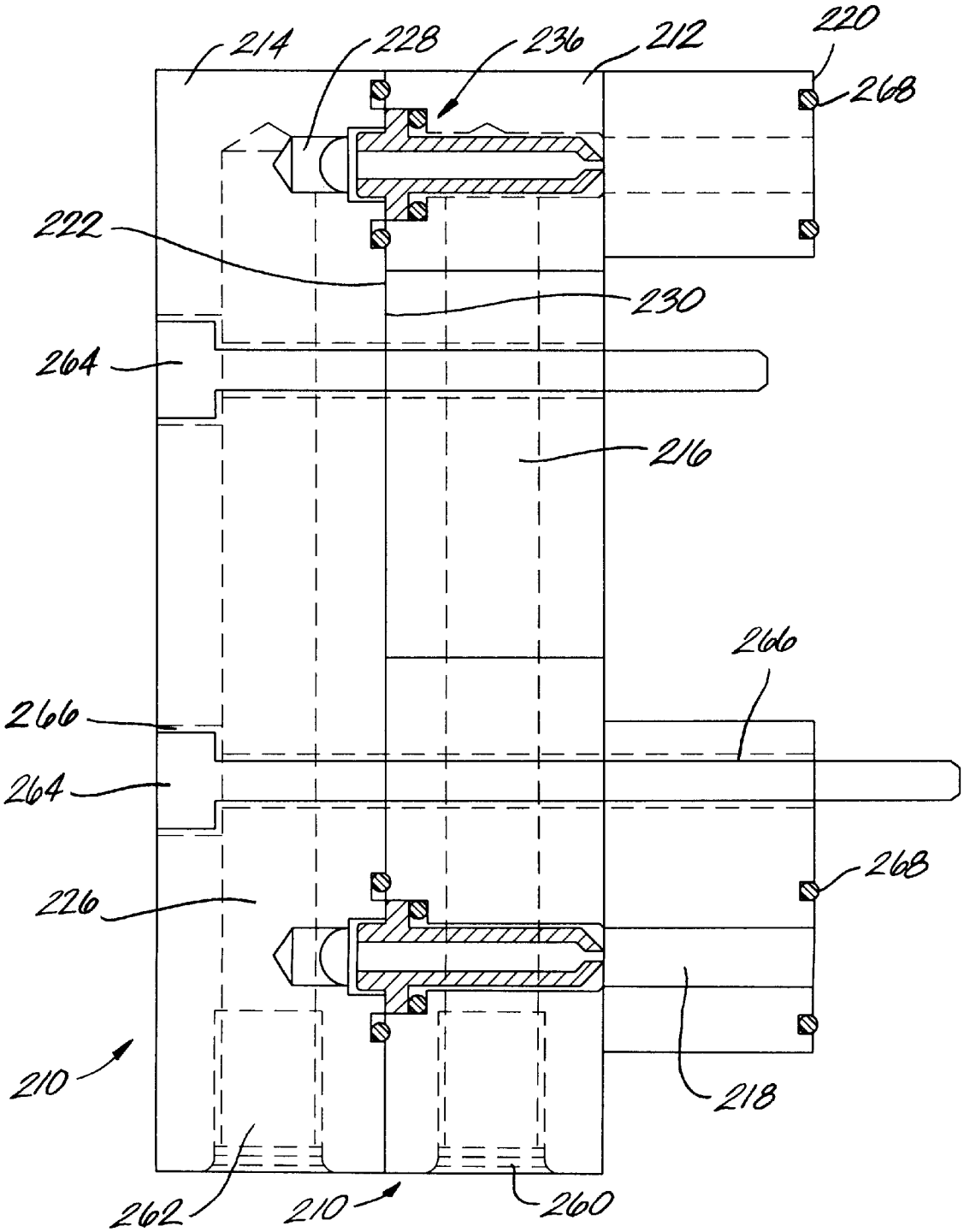
FIG. 14 is a side view of a second embodiment of the atomizer.

Turning to FIGS. 14–16, there are shown views of an alternate embodiment of an oil/air atomizer 210. For simplicity and low cost construction oil/air atomizer 210 includes an air supply portion 212, and an oil supply portion 214. Air supply portion 212 has a central air channel 216. Air/oil mist channels 218 intersect central air channel 216 and extend from front face 220 to rear face 222 of air supply base 212. A ledge 224 is provided in air/oil/mist channel 218, and creates an area of larger diameter. Oil supply portion 214 has a central oil channel 226 and transverse channel portions 228. Front face 230 of oil supply portion 214 includes recesses 232 for a sealing ring 234, such as an O-ring. Retention means, such as bolts 264 clamp together air supply portion 212 and oil supply portion 214. Jets 236 and filter caps 238 are fitted into atomizer unit 210.

Filter cap 238 has filter material 240 and a cap ring 242. Cap ring 242 fits over distal end 244 of jet and preferably seats on a rim 246. Rim 246 has a front face 248 and rear face 250. Jet 236 fits into air/oil mist channel 218 with a sealing means, such as an O-ring 252, placed between front face 248 and ledge 224. Transverse channel 228 has a ledge 254 which rides on cap ring 242, and prevents it from separating from rim 246. A portion of front face 230 of oil supply portion rides on rear face 250 of rim 246, and locks jet 236 in place. As shown particularly well in FIG. 15, air/oil/mist channel 218 is wider in diameter around a shaft 254 of jet 236. In function, oil will pass from central oil channel 226, pass through filter material 240, enter a channel 256 of jet and leave through orifice 258. Pressurized air will travel through central air channel 216 and pass around shaft 254 and exit through air/oil/mist channel 218. This traveling air will pick up oil passing through orifice 258 and form an atomized oil/air mist, which mist will travel out of oil/mist channel 218.

Atomizer unit 210 can be conveniently attached as a unit to a supercharger 10 or 130 to provide for oil mist lubrication. As shown in FIG. 14, pressurized air can be feed into central air channel 216 through air inlet 260. Oil will be fed into central oil supply channel 226 via an oil inlet 262. Bolts 264 passing through bores 266 in air supply portion 212 and oil supply portion 214 lock air supply portion 212 and oil supply portion 214 together and secure atomizer unit 210 to a supercharger (not shown). Sealing means 268, such as O-rings can be provided on front faces 220 for fluid and airtight securement.

As noted above, the superchargers 10 and 130 can be lubricated simply with pressurized oil rather than an oil/air mist, in which event oil alone (and not an oil/air mist) will travel through the channels and will be expelled onto the bearing races. The inventor has found that adding a swale 108 and the additional groove 110 in swale 108 on the perimeter of case improves the drainage. The benefits of using an air/oil mist are twofold. First, the pressurized air aids in expelling oil out of the gear case once used. Second, the oil/air mist assists the oil in permeating the bearing. Thus, using less oil, but with a quick throughput time, better cooling can be achieved. The splitter 94 also aids in the drainage of oil. All in all, the design provides a smaller yet more efficient gear case. Although the term oil has been used hereinabove, other lubricating fluids are intended to be encompassed by the term.

The above-described embodiments of the present invention are merely descriptive of its principles and are not to be considered limiting. The scope of the present invention instead shall be determined from the scope of the following claims including their equivalents.

What is claimed is:

1. A compact supercharger having a volute, a compressor wheel, and a drive portion, the drive portion comprising:

a drive gear having an outer circumference and a driven gear having an outer circumference, the drive gear adapted to engage with the driven gear, the driven gear having a driven gear shaft adapted to connect to the compressor wheel, and the drive gear having a drive gear shaft adapted to rotate the drive gear;

drive gear bearing races for rotatably supporting the drive gear shaft and drive gear and driven gear bearing races for rotatably supporting the driven gear shaft and driven gear; and a gear case having an inner chamber with a back wall, a front wall, perimeter walls, drive gear bearing mounting recesses to receive the drive gear bearing races, driven gear bearing mounting recesses to receive the driven gear bearing races, at least one oil inlet in the gear case to receive oil, and oil channels in communication with the at least one oil inlet and the driven gear bearing races, and at least one oil outlet on the gear case, wherein the outer circumference of the drive gear located in the gear case is in close proximity to at least portions of the perimeter walls of the inner chamber; and two splitters, each extending from portions of the perimeter side wall, each having a raised face with a lip portion, the raised face and lip being in close proximity with a portion of the outer circumference of the drive gear, each splitter having a channel extending generally below the lip, which channel communicates with one of two oil outlets, wherein the two splitters are spaced apart, wherein during rotation of the drive gear, oil will be expelled against the perimeter wall portion, travel down the perimeter walls and exit through the at least one oil outlet, thereby reducing windage of the oil in the gear case and assisting in power draining of oil from the gear case.

2. The compact supercharger of claim 1, further comprising at least one splitter located in the gear case in the vicinity of the at least one oil outlet, the at least one splitter having a face in close proximity to the outer circumference of the drive gear, and at least one passageway communicating with the at least one oil outlet.

3. The compact supercharger of claim 2, wherein the perimeter sidewall has a swale formed along at least a portion thereof in regions of sidewall near outer circumference of drive gear.

4. The compact supercharger of claim 3, wherein the swale extends at least partially into the passageway of the splitter.

5. The compact supercharger of claim 3, wherein an additional groove is formed in at least a portion of the swale.

6. The compact supercharger of claim 1, wherein the drive gear has a larger circumference than the driven gear and is located in the inner chamber of the gear case below the driven gear.

7. The compact supercharger of claim 1, wherein a slot is formed on a bottom of the drive gear bearing mounting recesses for oil drainage.

8. The compact supercharger of claim 1, wherein the gear case comprises a back portion and a cover portion, and one oil inlet is formed in the back portion and one oil inlet is formed in the cover portion, and the oil channels communicate with each other, and oil is delivered to one of the oil inlets with the other oil inlet being plugged.

9. The compact supercharger of claim 1, wherein the driven gear and driven gear bearing races are adapted to splash oil onto the drive gear and drive gear bearing races.

10. The compact supercharger of claim 9, wherein the pressurized air for the atomizer is supplied from the volute of the supercharger.

11. The compact supercharger of claim 1, further comprising an atomizer for mixing lubricating oil and pressurized air to generate an oil/air mist which is fed into one of the oil inlets.

12. The compact supercharger of claim 11, wherein the atomizer comprises an oil inlet end, at least one jet, at least one downstream channel, and at least one pressurized air aperture formed in the downstream channel through which pressurized air is supplied to form an oil/air mist that exits an oil/air mist outlet end.

13. The compact supercharger of claim 11, wherein the atomizer comprises an air supply portion with a central air supply channel and at least one air/oil mist channel in communication therewith, an oil supply portion with a central oil supply channel and at least one transverse channel, and at least one jet with an orifice, the orifice of the at least one jet extending into the air/oil mist channel.

14. The compact supercharger of claim 11, wherein the action of mist/oil mist being expelled against the perimeter wall causes oil to be separated from the oil/air mist, and the pressurized air aids in expelling oil out of the at least one oil outlet in the gear case.

15. The compact supercharger of claim 1, further comprising bearing cups for receiving the drive gear bearing races and driven gear bearing races, the bearing cups being incorporated in the gear case, and being formed of material having similar thermal expansion characteristics as the drive gear bearing races, and the driven gear bearing races, respectively.

16. The compact supercharger of claim 15, wherein pairs of bearing cups are joined together with struts to form unitary inserts.

17. The compact supercharger of claim 16, wherein the inserts are formed of ferrous material, and are cast into the gear case which is made of a different material.

18. A compact supercharger having a volute, a compressor wheel, a drive portion, and an atomizer for providing a lubricating oil/air mist to the supercharger, the supercharger comprising:

the atomizer being for mixing lubricating oil and pressurized air to create an oil/air mist; and a gear case for the supercharger adapted to accommodate gears and bearing means, the gear case having at least one inlet for the oil/air mist from the atomizer, channels communicating between the at least one inlet therethrough and the bearing means, and at least one oil outlet for draining oil from the gear case, wherein the bearing means comprise driven gear bearing races positioned in driven gear bearing mounting recesses, the driven gear bearing races rotatably carrying a shaft with a driven gear and adapted to connect to the compressor, a drive gear and drive gear bearing races positioned in drive gear bearing race recesses of the supercharger, and wherein the channels communicate with the driven gear bearing races to provide direct lubrication of the driven bearing races by oil/air mist, and oil is supplied to the drive gear and drive gear bearing races by being splashed from the driven gear bearing races and driven gear.

19. The compact supercharger of claim 18, wherein the atomizer comprises an oil inlet end, an oil jet, a downstream channel, and at least one pressurized air aperture formed in the downstream channel through which pressurized air is supplied to generate an oil/air mist that exits an oil/air mist outlet end.

20. The compact supercharger of claim 18, wherein the atomizer comprises an air supply portion with a central air supply channel and at least one air/oil mist channel in communication therewith, an oil supply portion with a central oil supply channel and at least one transverse channel, and at least one jet with an orifice, the orifice of the at least one jet extending into the air/oil mist channel.

21. The compact supercharger of claim 18, wherein the pressurized air for the atomizer is derived from the volute of the supercharger and fed to the atomizer via a hose.

22. The compact supercharger of claim 18, wherein the gear case comprises a base portion with a first oil/air mist inlet, and a cover portion with a second oil/air mist inlet, and wherein the channels comprise tunnels formed in the base portion and cover portion of gear case, the tunnels being in communication with each other, the first and second oil/air mist inlets, and the driven gear bearing races, and wherein the atomizer is connected to one of the two oil/air mist inlets, and the oil/air mist inlet not receiving the atomizer is plugged.

23. The compact supercharger of claim 18, wherein the gears comprises a drive gear having teeth and an outer circumference and a driven gear having teeth and an outer circumference, wherein the bearing means comprises drive gear bearing races and driven gear bearing races, wherein the gear case has an inner chamber with drive gear bearing mounting recesses to receive the drive gear bearing races and driven gear bearing mounting recesses to receive the driven gear bearing races, the inner chamber further having a back wall, a front wall, perimeter walls, the perimeter walls having a swale formed along at least a portion of the perimeter walls in the vicinity of the drive gear, wherein the outer circumference of the drive gear is in close proximity to at least portions of the perimeter walls of the inner chamber, wherein during rotation of the drive gear, oil will be expelled against the perimeter wall portion, travel down the swale, and exit through the oil outlet, thereby reducing windage of the oil in the gear case and assisting in power draining of oil from the gear case.

24. The compact supercharger of claim 23, further comprising a splitter located near a bottom of the gear case in the vicinity of the oil outlet, the splitter having leading edges in close proximity to the outer circumference of the drive gear, and passageway communicating with the oil outlet.

25. The compact supercharger of claim 23, further comprising a groove formed in at least a portion of the swale.

26. The compact supercharger of claim 23, wherein the driven gear has a smaller circumference and is located in the gear case above the drive gear.

27. A compact supercharger having a volute, a compressor wheel, a drive portion, and an atomizer for providing a lubricating oil/air mist to the supercharger, the drive portion comprising:

a drive gear having teeth and an outer circumference and a driven gear having teeth and an outer circumference, the driven gear having a shaft adapted to connect to the compressor wheel;

drive gear bearing races and driven gear bearing races; and a gear case having back portion with a back wall, perimeter sidewalls, and a lower portion, and a cover portion, the drive gear having a larger diameter than the driven gear and being located in the gear case below the driven gear, drive gear bearing mounting recesses to receive the drive gear bearing races, driven gear bearing mounting recesses to receive the driven gear bearing races, at least one oil/air inlet in the gear case to receive engine oil, and oil/air mist channels in communication with the at least one oil inlet and the driven gear bearing races, at least one oil outlet in the gear case, and at least one splitter located in the vicinity of the at least one oil outlet, the splitter having a curved upper face in close proximity to the outer circumference of the drive gear, and at least one passageway communicating with the at least one oil outlet.

28. The compact supercharger of claim 27, wherein the perimeter sidewall has a swale formed along at least a portion thereof in regions of sidewall near outer circumference of drive gear.

29. The compact supercharger of claim 28, wherein an additional groove is formed in at least a portion of the swale.

30. The compact supercharger of claim 27, wherein the supercharger comprises two splitters, extending from portions of the perimeter side wall, each having a raised face with a lip portion, the raised face and lip being in close proximity with a portion of the outer circumference of the drive gear, each splitter having a channel extending generally below the lip, which channel communicates with one of two oil outlets, wherein the two splitters are spaced apart.

31. The compact supercharger of claim 27, wherein a slot is formed on a bottom of the drive gear bearing mounting recesses for oil drainage, and one oil inlet is formed in the back portion and one oil inlet is formed in the cover portion, and the oil channels communicate with each other, and oil is delivered to one of the oil inlets with the other oil inlet being plugged.

32. The compact supercharger of claim 27, further comprising bearing cups for receiving the drive gear bearing races and driven gear bearing races, the bearing cups being incorporated in the gear case, and being formed of material having similar thermal expansion characteristics as the drive gear bearings races, and the driven gear bearing races, respectively.

33. The compact supercharger of claim 32, wherein pairs of bearing cups are joined together with struts to form unitary inserts.

34. The compact supercharger of claim 33, wherein the inserts are formed of ferrous material, and are cast into the gear case which is made of a different material.

35. The compact supercharger of claim 27, wherein the atomizer comprises an oil inlet end, at least one jet, at least one downstream channel, and at least one pressurized air aperture formed in the downstream channel through which pressurized air is supplied from the volute of the supercharger to generate an oil/air mist that exits an oil/air mist outlet end.

36. The compact supercharger of claim 27, wherein the atomizer comprises an air supply portion with a central air supply channel and at least one air/oil mist channel in communication therewith, an oil supply portion with a central oil supply channel and at least one transverse channel, and at least one jet with an orifice, the orifice of the at least one jet extending into the air/oil mist channel.

37. A compact supercharger having a volute, a compressor wheel,and a drive portion, the drive portion comprising:

a drive gear with a drive shaft and a driven gear with a driven gear shaft;

drive gear bearing races for rotatably supporting the drive gear shaft and drive gear and driven gear bearing races for rotatably supporting the driven gear shaft and driven gear; and a gear case having an inner chamber with a back wall, a front wall, perimeter walls; and unitary inserts having bearing cups for receiving the drive gear bearing races and bearing cups for the driven gear bearing races, the unitary inserts being incorporated in the gear case and being formed of material having similar thermal expansion characteristics as the drive gear bearing races and the driven gear bearing races.

38. The compact supercharger of claim 37, wherein in the unitary inserts, the bearing cups for receiving the drive gear bearing races and the bearing cups for receiving the driven gear bearing races are joined together with struts.

39. The compact supercharger of claim 37, wherein the unitary inserts are formed of ferrous material, and are cast into the gear case which is made of a dissimilar material.

40. A compact supercharger having a volute, a compressor wheel, a drive portion, and a modular atomizer for providing a lubricating oil/air mist to the supercharger, the supercharger comprising:

a modular atomizer for mixing lubricating oil and pressurized air to create an oil/air mist, the modular atomizer having an air supply portion with a central air supply channel and a plurality of air/oil mist channels in communication therewith, an oil supply portion with a central oil supply channel and an equal plurality of transverse channels, and an equal plurality of jets with orifices formed therethrough, the jets placed in and extending into but not blocking the air/oil mist channels, the air supply portion and the oil supply portion being detachably affixed together with the jets placed therebetween; and a gear case for the supercharger adapted to accommodate gears and bearing means, the gear case having at least one inlet for the oil/air mist from the atomizer, channels communicating between the at least one inlet therethrough and the bearing means, and at least one oil outlet for draining oil from the gear case.

41. The compact supercharger of claim 40, wherein each jet has a filter cap that fits over a distal end of the jet to prevent the orifice from becoming blocked.

42. The compact supercharger of claim 40, wherein air supply portion and the oil supply portion are held together and attached to the gear case of the supercharger with bolts.

* * * * *